US010770028B2

(12) United States Patent
Mese et al.

(10) Patent No.: US 10,770,028 B2
(45) Date of Patent: Sep. 8, 2020

(54) DISPLAY BRIGHTNESS ADJUSTMENT BASED ON AMBIENT LIGHT LEVEL

(71) Applicant: Lenovo (Singapore) Pte. Ltd., Singapore (SG)

(72) Inventors: John Carl Mese, Cary, NC (US); Russell Speight VanBlon, Raleigh, NC (US); Arnold S. Weksler, Raleigh, NC (US); Nathan J. Peterson, Oxford, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 15/486,065

(22) Filed: Apr. 12, 2017

(65) Prior Publication Data

US 2018/0301114 A1 Oct. 18, 2018

(51) Int. Cl.
*G09G 5/10* (2006.01)

(52) U.S. Cl.
CPC ..... *G09G 5/10* (2013.01); *G09G 2320/0626* (2013.01); *G09G 2360/144* (2013.01); *G09G 2370/02* (2013.01); *G09G 2370/16* (2013.01)

(58) Field of Classification Search
CPC ..... G09G 2320/0626; G09G 2360/144; G09G 5/10; G06F 3/0412; G06F 3/044; G01J 1/4204; G01J 1/00; G01J 1/32
See application file for complete search history.

(56) References Cited

U.S. PATENT DOCUMENTS

2005/0051708 A1* 3/2005 Hotelling ..... G01J 1/00 250/214 AL
2013/0076712 A1* 3/2013 Zheng ..... G01J 1/32 345/207
2013/0328842 A1* 12/2013 Barnhoefer ..... G09G 3/3406 345/207
2014/0240338 A1* 8/2014 Patino ..... G09G 3/20 345/589
2017/0316762 A1* 11/2017 El-Ghoroury ..... G06F 3/017
2017/0336864 A1* 11/2017 Broz ..... G06F 3/013

* cited by examiner

*Primary Examiner* — Stephen T. Reed

(74) *Attorney, Agent, or Firm* — Ference & Associates LLC

(57) ABSTRACT

One embodiment provides a method, including: detecting a change in light level; receiving, from at least one other source, data associated with an ambient light level; determining, using a processor, whether the change in light level corresponds to a change in the ambient light level; and adjusting, responsive to determining that the change in light level corresponds to the change in the ambient light level, a brightness level of a display operatively coupled to an information handling device. Other aspects are described and claimed.

20 Claims, 3 Drawing Sheets

DISPLAY BRIGHTNESS ADJUSTMENT BASED ON AMBIENT LIGHT LEVEL

BACKGROUND

Information handling devices ("devices"), for example smart phones, tablet devices, laptop computers, smart TVs, and the like, may be equipped with one or more sensors that are capable of detecting incoming light. The light may originate from a variety of light generating sources such as artificial light sources (e.g., ceiling lights, lamps, etc.), natural light sources (sunlight, moonlight, etc.), or a combination thereof. Responsive to detecting a change in incoming light levels, devices may automatically adjust a brightness setting of a display operatively coupled to the device.

BRIEF SUMMARY

In summary, one aspect provides a method, comprising: detecting a change in light level; receiving, from at least one other source, data associated with an ambient light level; determining, using a processor, whether the change in light level corresponds to a change in the ambient light level; and adjusting, responsive to determining that the change in light level corresponds to the change in the ambient light level, a brightness level of a display operatively coupled to an information handling device.

Another aspect provides an information handling device, comprising: a processor; a memory device that stores instructions executable by the processor to: detect a change in light level; receive, from at least one other source, data associated with an ambient light level; determine whether the change in light level corresponds to a change in the ambient light level; and adjust, responsive to determining that the change in light level corresponds to the change in the ambient light level, a brightness level of a display operatively coupled to the information handling device.

A further aspect provides a product, comprising: a storage device that stores code, the code being executable by a processor and comprising: code that detects a change in light level; code that receives, from at least one other source, data associated with an ambient light level; code that determines whether the change in light level corresponds to a change in the ambient light level; and code that adjusts, responsive to determining that the change in light level corresponds to the change in the ambient light level, a brightness level of a display operatively coupled to an information handling device.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
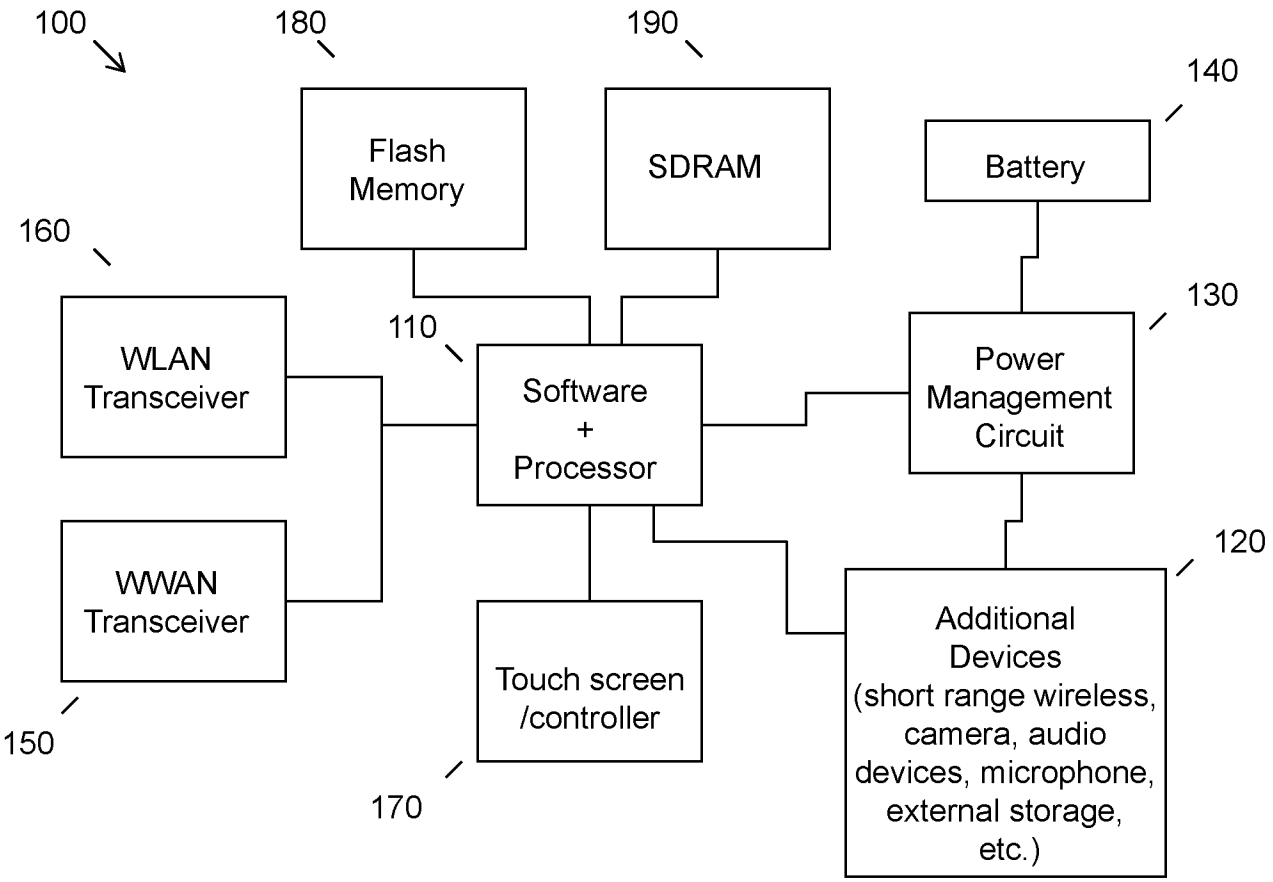
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Devices with light detecting sensors (e.g., ambient light sensors, photocell, etc.) are designed to adjust the brightness level of a display screen coupled to the device when incoming light levels change. For example, when a device detects that ambient light in the room has decreased (e.g., as a result of a user transitioning from a brighter environment to a darker environment, the environment transitioning from day to night, etc.), the brightness of the screen may be decreased, or increased depending on the settings of the device or settings specified by the user. These dynamic adjustment methods enable users to comfortably visualize the contents on the display, regardless of the change in light level.

However, adjusting the brightness of a display using conventional adjustment methods may not always be the correct action when a sensor detects a change in light level. For example, a presenter standing in front of a television containing a light sensor may inadvertently block the light between the light source and the sensor. Responsive to detecting the change in incoming light level, the television may adjust the brightness level of the display (e.g., decrease the brightness level to correspond with the reduction in incoming light) even though the ambient light in the room remains unchanged. In other words, the presenter blocking the light sensor may cause the brightness of the television to change even though the brightness does not need to be adjusted. Another example may correspond to a user playing a game on a mobile device (e.g., smart phone, tablet, handheld gaming device, etc.) in a room with a single light source (e.g., a lamp, overhead light, etc.) and moving positions slightly so that light no longer falls directly on the sensor. Although the user has not transitioned environments and the ambient light has not changed, the brightness of the screen may be decreased responsive to detecting the change in light level at the sensor. In both of these examples, the change in the incoming light level does not correspond to a change in the ambient light level. These scenarios result in an undesired change to the brightness of the display, which may make it difficult for users to visualize the display contents.

Existing solutions rely on a plurality of light detecting sensors to be positioned around a user's environment (e.g., a room, around the device, on the device, etc.) so that even if one of the sensors is blocked, another sensor may be able to properly identify the ambient light level. However, these solutions are not only costly and burdensome to implement, but they become largely ineffective when a user transitions to different environments. Additionally, it is not feasible for a user to position and install these sensors in each new environment they enter. Additionally, these sensors must be coupled to the device so that the device can respond to the changes to the ambient light. Coupling these sensors to each device that may be in the environment may be very time-consuming and costly.

Accordingly, an embodiment provides a method for determining whether a detected change in light level corresponds to a change in the ambient light level. In an embodiment, a change in light level may be detected (e.g., using one or more sensors operatively coupled to a device, etc.) at a device. Additionally, sensor data associated with an ambient light level may be received from at least one other source (e.g., another device, etc.). An embodiment may then determine whether the change in light level corresponds to a change in the ambient light level. Responsive to the determination, an embodiment may determine whether or not to adjust a brightness level of a display operatively coupled to the device. Such a method may prevent instances of unnecessary display brightness adjustment.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., an image sensor such as a camera. System 100 often includes a touch screen 170 for data input and display/rendering. System 100 also typically includes various memory devices, for example flash memory 180 and SDRAM 190.

Figure 2:
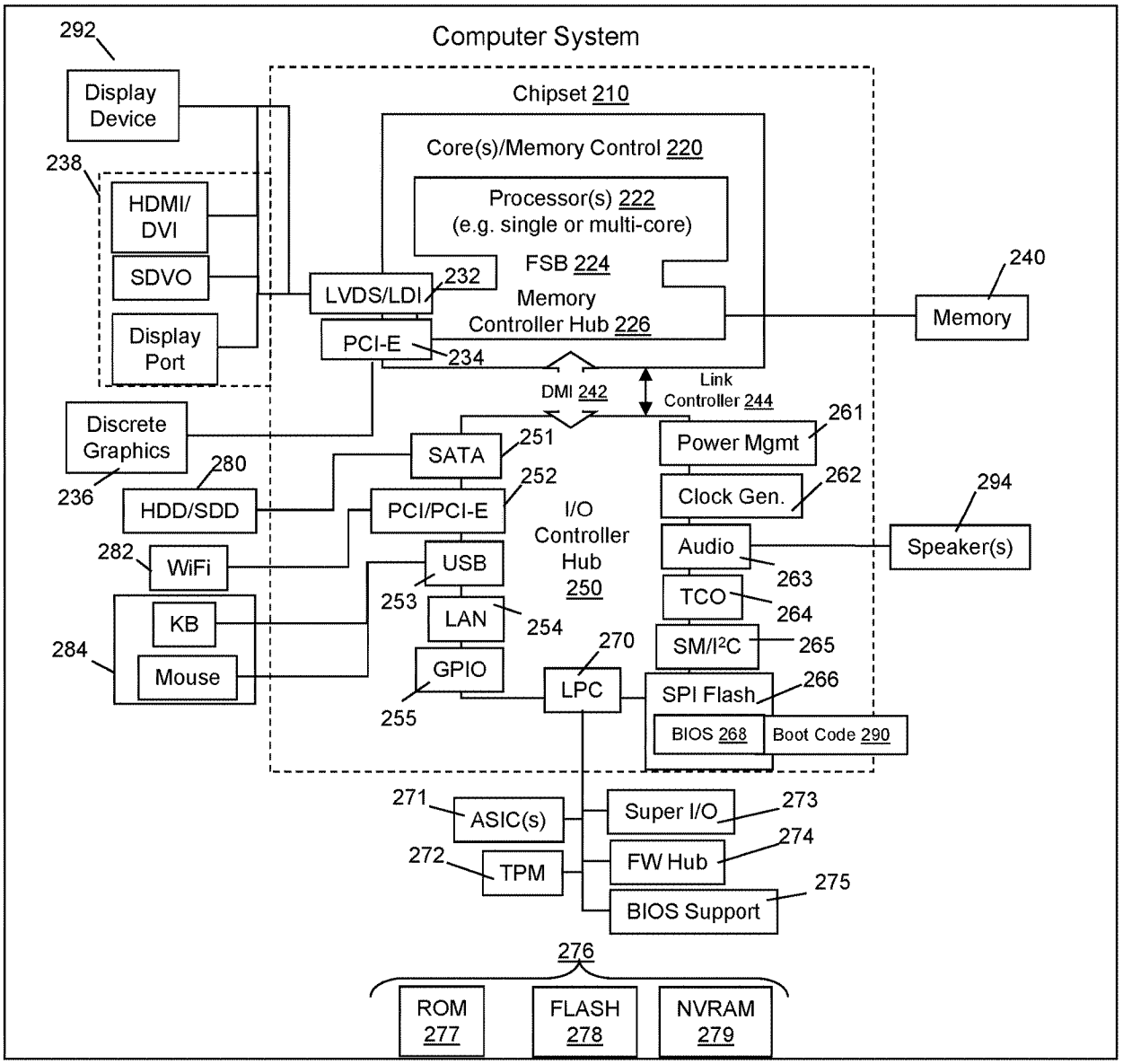
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as tablets, smart phones, personal computer devices generally, and/or electronic devices may be devices used by users having an associated display device. Accordingly, the devices may be used making a determination for adjusting the brightness settings for a display associated with the device. For example, the circuitry outlined in FIG. 1 may be implemented in a tablet or smart phone embodiment, whereas the circuitry outlined in FIG. 2 may be implemented in a personal computer embodiment.

Figure 3:
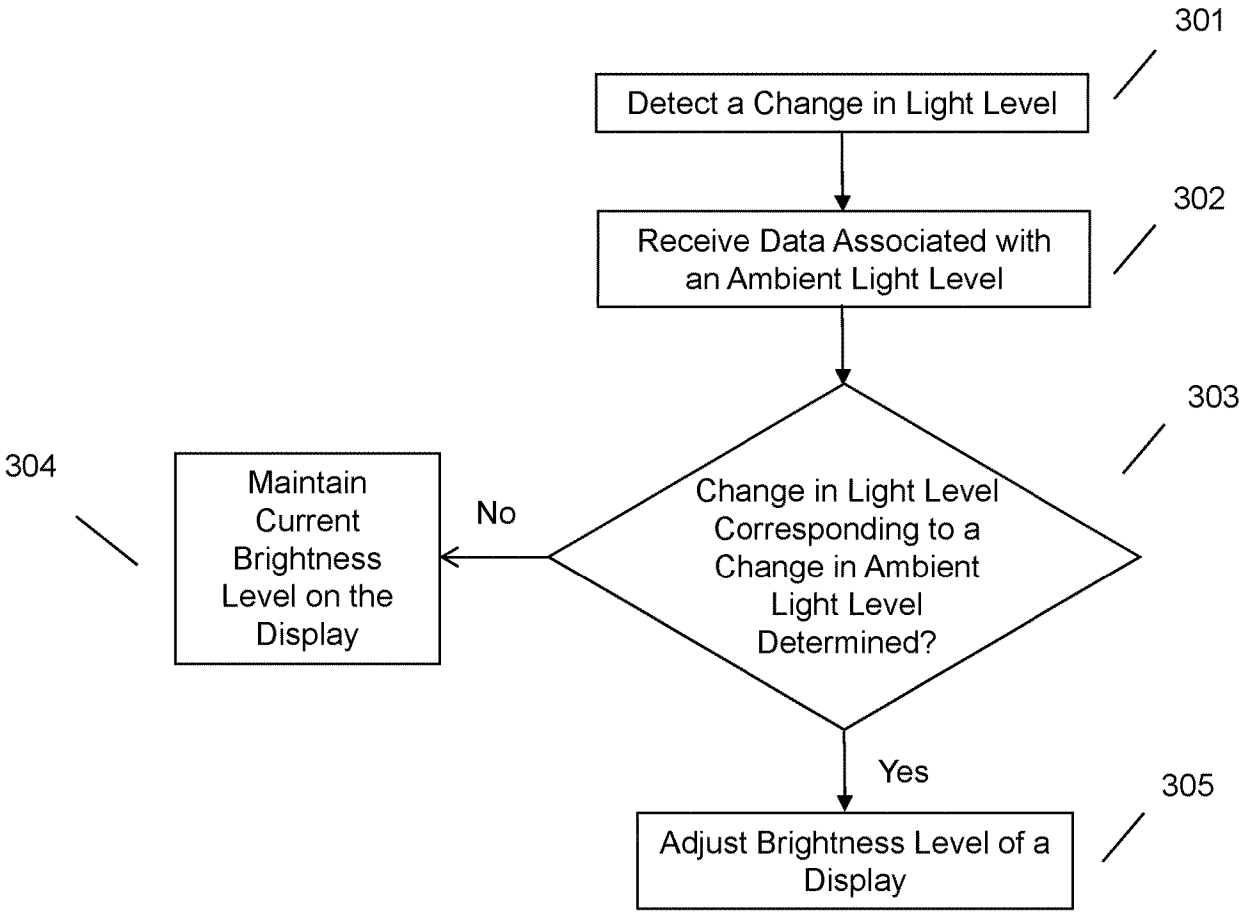
FIG. 3 illustrates an example method of determining whether or not to adjust the brightness level of a display.

Referring now to FIG. 3, an embodiment may determine whether a detected change in light level corresponds to a change in ambient light level and based on this determination an embodiment may determine whether or not to adjust the brightness level of a display screen operatively coupled to a device. At 301, an embodiment may detect a change in light level at a device (e.g., smart phone, tablet, computer, television, etc.). In an embodiment, the detecting may be done by one or more sensors (e.g., ambient light sensors, photocells, other light detecting sensors, etc.) operatively coupled to the device. The sensors may be integral to the device or may be located aside from the device (e.g., in the environment, etc.) and communicate with the device.

The detected change in light level may correspond to a change in the amount of light detected by the one or more sensors. For example, the detected change in light may correspond to a change in the ambient light level of the surrounding environment (e.g., the room, the surrounding outdoor area, etc.) the device is located in. Alternatively, the change in light level may not be indicative of a change in the ambient light level of the surrounding environment, but may instead be a result of a temporary light blocking event. For example, the detected change in light level may be a result of a user's appendage (e.g., hand, head, other body part, etc.) temporarily blocking the light between a light source (e.g., a lamp, overhead light, environment light, etc.) and the device's sensor.

At 302, an embodiment may receive sensor data associated with an ambient light level from at least one other source. The ambient light level may correspond to the brightness level of the surrounding environment the device is located in. For example, the brightness level of the surrounding environment may include the brightness level of a room, outside, cubicle, within a particular radius of the device, and the like. In an embodiment, the at least one other source may be another user device (e.g., smart phone, smart watch, tablet, etc.) associated with the same or another user, another electronic device (e.g., smart lamp, smart light, environment controller, etc.) positioned in or near the vicinity of the device, environment sensor, or the like. In an embodiment, the device may receive sensor data from the sensors associated with the device itself as well as sensor data from the at least one other source. In an embodiment, sensor data may be communicated from the other sources to the device via a wireless connection (e.g., using a BLUETOOTH connection, near field communication (NFC), wireless connection techniques, etc.), a wired connection (e.g., the device is coupled to another device or source, etc.), through a connected data storage system (e.g., via cloud storage, remote storage, local storage, network storage, etc.), and the like.

In an embodiment, sensor data may only be received from devices that are determined to be in an ambient light detecting orientation. In an embodiment, an ambient light detecting orientation may refer to an orientation where a device's sensors are capable of accurately detecting the ambient light level of the surrounding environment. For example, a device may be in an ambient light detecting orientation when the device is substantially stationary and/or the device's light sensors are not blocked or obstructed. Sensor data obtained from devices determined not to be in an ambient light detecting orientation (e.g., devices having blocked sensors, devices that are moving, etc.) may be ignored because this data may not provide an accurate indication of the ambient light level of the environment. For example, a device in a user's pocket may not be in an ambient light detecting orientation. In an embodiment, the determination of whether a device is an ambient light detecting orientation may be accomplished by using data obtained from an accelerometer (e.g., to detect whether the device is moving, what direction the device is moving, etc.), a proximity sensor (e.g., to detect nearby objects that may be blocking the sensor, etc.), a combination thereof, or the like.

In an embodiment, sensor data may only be received from sources within a predetermined distance from the device. For example, an embodiment may only receive sensor data from sources within 50 feet of the device. In another embodiment, the predetermined distance may be a predetermined location (e.g., a park, another outdoor area, etc.) and an embodiment may only receive sensor data from other sources located in that location. For example, an embodiment may only receive sensor data from other sources located in substantially the same location as the device. The location of the device and the other sources may be determined, for example, by using GPS data, using triangulation data, based upon user input, using information from other sources (e.g., network identification data, signal strength data, etc.) and the like. For example, a user may identify that the device is currently located at "Home." Accordingly, an embodiment may only use other sources that are also located at "Home." In an embodiment, the predetermined distance or predetermined location may be set by the user. For example, a user may identify how close the other source should be to the device.

At 303, an embodiment may determine whether the change in light level corresponds to a change in the ambient light level of the surroundings. To make this determination an embodiment may correlate the change in light level to the data received from the other sources. For example, the light sensor may determine that the brightness level has increased. The device may then poll or obtain light sensor data from the other sources. If the sensor data from the other sources also designate that the brightness level has increased, the device may determine that the change in light level corresponds to a change in the ambient light level. If the sensor data from other sources do not identify that the brightness level has increased, the device may determine that the change in light level does not correspond to a change in the ambient light level.

If more than one other source is available, the determination may be based upon a collective determination. For example, the system may use a majority rule, auctioneer circuit, or other rule set to determine whether the ambient light level has changed. Additionally, the system may disregard particular sources. For example, if the system identifies that a particular source fails to provide consistent light data or the light data provided by the source always mismatches other sources, the system may ignore the data received from this source or may not poll or otherwise obtain data from this source. Additionally, some sources may have a higher priority than other sources. For example, depending on the location of the source, a reliability of data from the source, or other parameters, the system may identify a particular source as a higher or lower priority. Data from a higher priority source may be given a higher weight in determining whether the ambient light has changed. Alternatively, the system may not identify a source as being a higher or lower priority, but may instead assign a particular weight to a particular device. In other words, the weighting assigned to the source or data from the source may not be dependent on the priority of the device or source.

Responsive to determining, at 303, that the change in light level corresponds to a change in the ambient light level of the surroundings, an embodiment may adjust, at 305, the brightness level of a display screen associated with the device. In an embodiment, the brightness level of the display screen may either be increased or decreased depending on the change in the ambient light level. For example, responsive to determining that the ambient light level is reduced, an embodiment may automatically reduce the brightness level of the display screen or may increase the brightness level of the display screen depending on the settings of the device. Alternatively, responsive to determining that the ambient light level is increased, an embodiment may automatically increase the brightness level of the display screen or decrease the brightness level of the display screen depending on the settings of the device.

In an embodiment, the brightness level of the display screen may be adjusted by a predetermined amount which may correspond to the change in the ambient light level. The predetermined amount may correspond to an amount required for a user to comfortably visualize the content being displayed on the device. For example, if the ambient light level increases by 5 units, an embodiment may increase the brightness level of the display by a corresponding amount in order to allow the user to visualize the contents on the display.

Responsive to determining, at 303, that the change in light level does not correspond to a change in the ambient light level of the surroundings, an embodiment may maintain, at 304, the current brightness level on the display screen.

The various embodiments described herein thus represent a technical improvement to conventional display brightness adjustment techniques. Using the techniques described herein, an embodiment may determine whether a detected change in light level corresponds to a change in the ambient light level and, based on this determination, determines whether or not to adjust a brightness setting on the device. Such techniques prevent the unnecessary adjustment of display brightness settings when a detected change in light level does not correspond to a change in the ambient light level.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, a system, apparatus, or device (e.g., an electronic, magnetic, optical, electromagnetic, infrared, or semiconductor system, apparatus, or device) or any suitable combination of the foregoing. More specific examples of a storage device/medium include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

detecting, at an information handling device, a change in light level to a new light level;

communicating, to a plurality of other devices that are separate from the information handling device, the detected change in light level;

receiving, in response to the communicating and from the plurality of other devices, light level data identified by each of the plurality of other devices;

identifying, from the received light level data, a majority light level, wherein the identifying comprises:

disregarding the light level data received from each of the plurality of other devices previously determined as being inconsistent providers of accurate light level data; and identifying, from the light level data remaining after the disregarding, the majority light level;

determining, using a processor, that the change in light level corresponds to a change in an ambient light level via comparing the new light level to the majority light level and thereafter identifying that the new light level is substantially equivalent to the majority light level; and adjusting, responsive to the determining, a brightness level of a display operatively coupled to the information handling device.

2. The method of claim 1, wherein the adjusting comprises adjusting by not more than an insubstantial amount, responsive to determining that the change in light level does not correspond to the change in the ambient light level, the brightness level of the display.

3. The method of claim 1, wherein the adjusting comprises increasing the brightness level of the display responsive to determining that the change in the ambient light level comprises an increase of the ambient light level.

4. The method of claim 3, wherein the increasing comprises increasing the brightness level by a predetermined amount corresponding to the change in the ambient light level.

5. The method of claim 1, wherein the adjusting comprises decreasing the brightness level of the display responsive to determining that the change in the ambient light level comprises a decrease of the ambient light level.

6. The method of claim 5, wherein the detecting comprises detecting the change in light level at the information handling device.

7. The method of claim 1, wherein the receiving data comprises receiving sensor data.

8. The method of claim 1, wherein the at least one other device that is separate from the information handling device is determined to be in an ambient light detecting orientation.

9. The method of claim 8, wherein the ambient light detecting orientation is determined using at least one of an accelerometer and a proximity sensor.

10. The method of claim 1, wherein the at least one other device is within a predetermined distance from the information handling device.

11. An information handling device, comprising:

a processor;

a memory device that stores instructions executable by the processor to:

detect, at the information handling device, a change in light level to a new light level;

communicate, to a plurality of other devices that are separate from the information handling device, the detected change in light level;

receive, in response to the communicating and from the plurality of other devices, light level data identified by each of the plurality of other devices;

identify, from the received light level data, a majority light level, wherein the instructions executable by the processor to identify comprise instructions executable by the processor to:

disregard the light level data received from each of the plurality of other devices previously determined as being inconsistent providers of accurate light level data; and identify, from the light level data remaining after the disregarding, the majority light level;

determine that the change in light level corresponds to a change in an ambient light level via comparing the new light level to the majority light level and thereafter identifying that the new light level is substantially equivalent to the majority light level; and adjust, responsive to the determining, a brightness level of a display operatively coupled to the information handling device.

12. The information handling device of claim 11, wherein the instructions executable by the processor to adjust comprise instructions executable by the processor to adjust by not more than an insubstantial amount, responsive to determining that the change in light level does not correspond to the change in the ambient light level, the brightness level of the display.

13. The information handling device of claim 11, wherein the instructions executable by the processor to adjust comprise instructions executable by the processor to increase the brightness level of the display responsive to determining that the change in the ambient light level comprises an increase of the ambient light level.

14. The information handling device of claim 13, wherein the instructions executable by the processor to increase comprise instructions executable by the processor to increase the brightness level by a predetermined amount corresponding to the change in the ambient light level.

15. The information handling device of claim 11, wherein the instructions executable by the processor to adjust comprise instructions executable by the processor to decrease the brightness level of the display responsive to determining that the change in the ambient light level comprises a decrease of the ambient light level.

16. The information handling device of claim 15, wherein the instructions executable by the processor to detect comprise instructions executable the processor to detect the change in light level at the information handling device.

17. The information handling device of claim 11, wherein the instructions executable by the processor to receive data comprise instructions executable by the processor to receive sensor data.

18. The information handling device of claim 11, wherein at least one other device that is separate from the information handling device is determined to be in an ambient light detecting orientation.

19. The information handling device of claim 18, wherein the ambient light detecting orientation is determined using at least one of an accelerometer and a proximity sensor.

20. A product, comprising:

a storage device that stores code, the code being executable by a processor and comprising:

code that detects, at an information handling device, a change in light level to a new light level;

code that communicates, to a plurality of other devices that are separate from the information handling device, the detected change in light level;

code that receives, in response to the communicating and from the plurality of other devices, light level data identified by each of the plurality of other devices;

code that identifies, from the received light level data, a majority light level data, wherein the code that identifies comprises code that:

disregards the light level data received from each of the plurality of other devices previously determined as being inconsistent providers of accurate light level data; and identifies, from the light level data remaining after the disregarding, the majority light level;

code that determines that the change in light level corresponds to a change in an ambient light level via comparing the new light level to the majority light level and thereafter identifying that the new light level is substantially equivalent to the majority light level; and code that adjusts, responsive to the determining, a brightness level of a display operatively coupled to the information handling device.

* * * * *